US009351892B2

(12) United States Patent
Gowda et al.

(10) Patent No.: US 9,351,892 B2
(45) Date of Patent: May 31, 2016

(54) PERCUSSION THERAPY SYSTEM, APPARATUS AND METHOD

(75) Inventors: Raj K. Gowda, Corona, CA (US); Dan F. Rosenmayer, Corona, CA (US); Richard Jeff Garcia, Yucaipa, CA (US)

(73) Assignee: KAP Medical, Corona, CA (US)

( * ) Notice: Subject to any disclaimer, the term of this patent is extended or adjusted under 35 U.S.C. 154(b) by 930 days.

(21) Appl. No.: 12/109,806

(22) Filed: Apr. 25, 2008

(65) Prior Publication Data

US 2009/0270774 A1 Oct. 29, 2009

(51) Int. Cl.

*A61H 19/00* (2006.01)
*A61G 7/057* (2006.01)
*A61H 23/02* (2006.01)

(52) U.S. Cl.

CPC ..... *A61G 7/05776* (2013.01); *A61H 23/0236* (2013.01); *A61G 2203/46* (2013.01); *A61H 2201/0134* (2013.01); *A61H 2201/0138* (2013.01); *A61H 2201/0142* (2013.01); *A61H 2201/0146* (2013.01); *A61H 2201/0149* (2013.01); *A61H 2201/0176* (2013.01); *A61H 2201/164* (2013.01); *A61H 2201/1619* (2013.01); *A61H 2201/1623* (2013.01); *A61H 2201/5002* (2013.01); *A61H 2201/5084* (2013.01); *A61H 2201/5097* (2013.01)

(58) Field of Classification Search

CPC B60R 21/205; B60R 21/36; B60R 2021/003; B60R 2021/0407; B60R 21/045; B60R 21/34; B60R 21/0152; B60R 21/01534; B60R 21/01536; B60R 21/01542; A47C 27/082; A47C 27/083; A47C 31/123; A61B 5/0205; A61B 5/103; A61B 5/411; A61B 5/6892; A61B 5/02; A61B 5/1115; A61B 5/6891; A61B 2562/0209; A61B 17/225; A61B 17/22004; A61B 8/08; A61B 8/0883; A61B 8/4455; A61B 8/483

USPC ..... 601/46, 148, 149–151; 600/25; 73/493; 5/713, 714

See application file for complete search history.

(56) References Cited

U.S. PATENT DOCUMENTS 4,033,332 A 7/1977 Hardway, Jr. et al.
4,179,692 A 12/1979 Vance (Continued)

FOREIGN PATENT DOCUMENTS

EP 0990435 A1 4/2000

OTHER PUBLICATIONS

Lee, Mark, Application Note 2394, "CapSense Best Practices," Jan. 14, 2008, 11 pages, Cypress Semiconductor Corp., San Jose, CA.

(Continued)

*Primary Examiner* — Michael Brown
(74) *Attorney, Agent, or Firm* — Faegre Baker Daniels LLP

(57) ABSTRACT

A sonic percussion therapy system includes a patient support apparatus and a control module. The sonic percussion structure is attached to the inflatable cell so that the sonic percussion structure moves in response to movement of the inflatable cell. The control module includes a sonic percussion control module and a position control module. The sonic percussion control module independently controls frequency and/or intensity of at least one of the plurality of sonic percussion structures. The position control module selectively raises and lowers at least one of the plurality of sonic percussion structures with respect to a patient surface.

25 Claims, 10 Drawing Sheets

(56) References Cited

U.S. PATENT DOCUMENTS

| | | | | |
|---|---|---|---|---|
| 4,474,185 | A | 10/1984 | Diamond | |
| 4,539,560 | A | 9/1985 | Fleck et al. | |
| 4,771,637 | A * | 9/1988 | Kubler | 73/493 |
| 5,010,772 | A | 4/1991 | Bourland et al. | |
| 5,062,169 | A | 11/1991 | Kennedy et al. | |
| 5,314,403 | A * | 5/1994 | Shaw | 601/148 |
| 5,410,297 | A | 4/1995 | Joseph et al. | |
| 5,611,096 | A | 3/1997 | Bartlett et al. | |
| 5,695,455 | A | 12/1997 | Alton, Jr. et al. | |
| 5,808,552 | A | 9/1998 | Wiley et al. | |
| 6,025,782 | A | 2/2000 | Newham | |
| 6,067,019 | A | 5/2000 | Scott | |
| 6,094,762 | A | 8/2000 | Viard et al. | |
| 6,133,837 | A | 10/2000 | Riley | |
| 6,297,738 | B1 | 10/2001 | Newham | |
| 6,367,579 | B1 * | 4/2002 | Wiener | 181/199 |
| 6,439,950 | B1 * | 8/2002 | Goldman et al. | 446/220 |
| 6,493,888 | B1 | 12/2002 | Salvatini et al. | |
| 6,551,450 | B1 | 4/2003 | Thomas et al. | |
| 6,582,274 | B1 * | 6/2003 | Chernek et al. | 446/397 |
| 6,682,472 | B1 * | 1/2004 | Davis | 600/25 |
| 6,696,135 | B2 * | 2/2004 | Simhaee | 428/166 |
| 6,743,250 | B2 * | 6/2004 | Renfro | 607/104 |
| 6,778,090 | B2 | 8/2004 | Newham | |
| 6,953,439 | B1 | 10/2005 | Kabemba | |
| 7,171,711 | B2 | 2/2007 | Gowda | |
| 2004/0177450 | A1 * | 9/2004 | Salvatini et al. | 5/714 |
| 2006/0272097 | A1 * | 12/2006 | Dionne et al. | 5/713 |
| 2007/0070684 | A1 | 3/2007 | Poulos | |

OTHER PUBLICATIONS

Kremin, Victor et al., Application Note 42851, "Proximity Detection in the Presence of Metal Objects," Jan. 25, 2008, 10 pages, Cypress Semiconductor Corp., San Jose, CA.

International Search Report and Written Opinion from European Patent Office; International Application No. PCT/US2009/035123; dated Jan. 5, 2010.

* cited by examiner

PERCUSSION THERAPY SYSTEM, APPARATUS AND METHOD

FIELD

The present disclosure generally relates to mattresses designed for use with patients, and more particularly, to mattresses that provide percussion and/or vibration therapy to patients.

BACKGROUND

Both patients and patient service providers benefit from products that provide features that increase therapeutic effectiveness, provide additional benefits, provide greater patient comfort and/or reduce patient cost. Part of the patient care services provided by patient service providers includes the administering of certain therapies such as percussion therapy while a patient is in bed. As known in the art, percussion therapy can be useful for treating a variety of ailments. For example, percussion therapy can be useful in breaking up fluid in the lungs to help prevent the fluid from settling and/or to aid in removing the fluid from the lungs.

Existing percussion therapy mattresses use air forced through bladders and/or unbalanced mechanical motors to provide percussion therapy. These known methods do not selectively provide percussion therapy to particular area of a patients body. In addition, known methods are incapable of varying frequency of the percussion therapy independent from the intensity of the percussion therapy.

Accordingly, it is desirable to provide an improved method and apparatus for providing percussion therapy to a patient that overcomes one or more of the aforementioned drawbacks.

BRIEF DESCRIPTION OF THE DRAWINGS

The invention will be more readily understood in view of the following description when accompanied by the below figures, wherein like reference numerals represent like elements.

DETAILED DESCRIPTION

Figure 1:
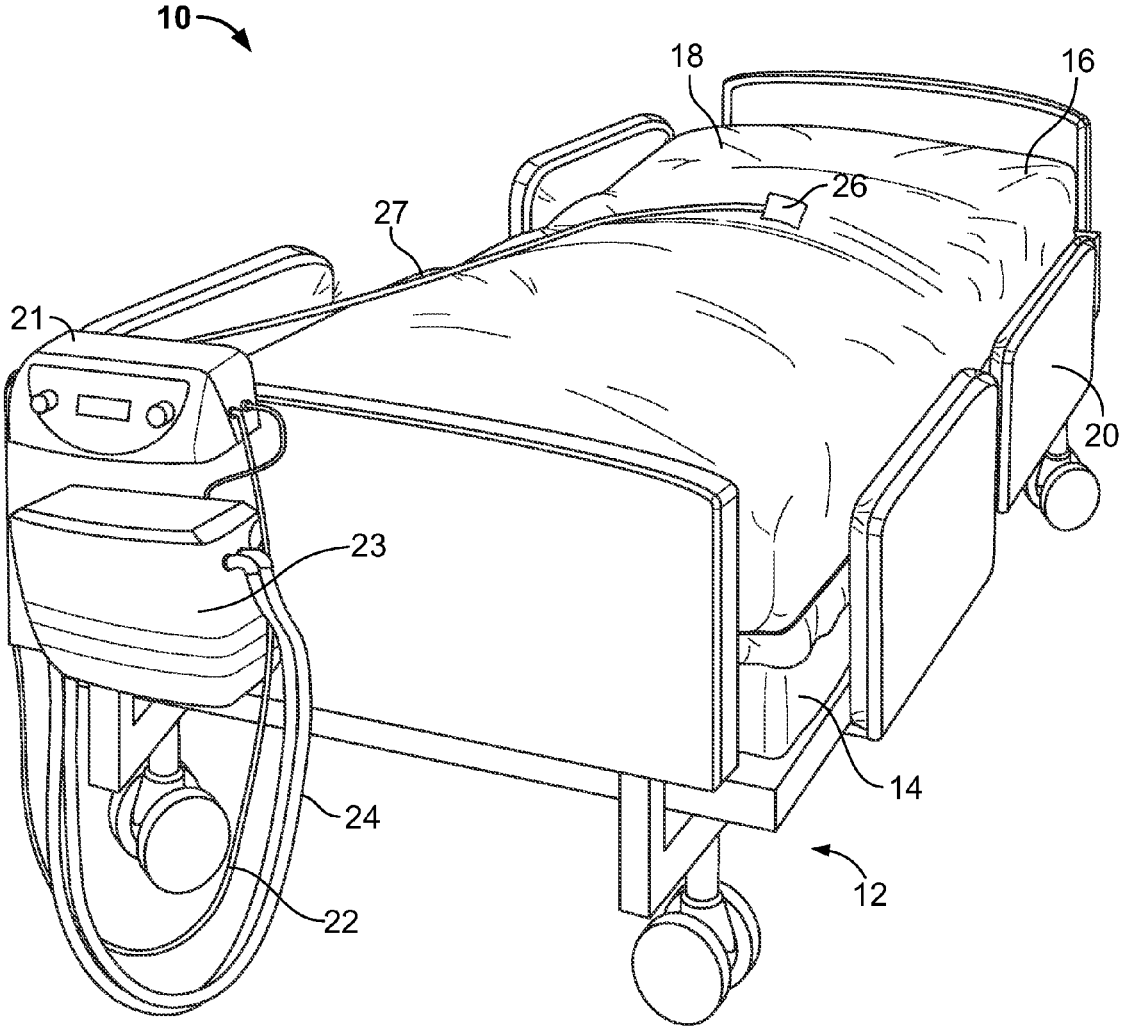
FIG. 1 is an exemplary bed that includes a patient support apparatus having a sonic percussion therapy apparatus according to the present disclosure.

In one example, a sonic percussion therapy system includes a patient support apparatus and a control module. In one example, the patient support apparatus includes a first plurality of inflatable cells, a second plurality of inflatable cells, and a plurality of sonic percussion structures. In one example, the second plurality of inflatable cells are beneath a portion of the first plurality of inflatable cells. In one example, the plurality of sonic percussion structures are disposed between the second plurality of inflatable cells and the portion of the first plurality of inflatable cells. In one example, the control module includes a sonic percussion control module and a position control module. In one example, the sonic percussion control module independently controls frequency and/or intensity of at least one of the plurality of sonic percussion structures. In one example, the position control module selectively raises and lowers at least one of the plurality of sonic percussion structure with respect to a patient surface. In one example, the sonic percussion therapy system includes a top cover. In one example, the top cover includes a planar surface and at least one accelerometer. The planar surface is adapted to substantially cover the patient support apparatus. In one example, the accelerometer is operatively coupled to the planar surface. In one example, the accelerometer measures frequency and/or intensity of vibrations of the patient support apparatus.

The system, apparatus and method provide, among other advantages, sonic percussion therapy having a sonic percussive waveform, wherein the frequency and intensity of the waveform can be independently controlled to provide customized treatment for each individual patient. In addition, the system, method and apparatus can selectively target a particular area of the patient's body in order to provide customized treatment for that particular area of the body. Furthermore, the sonic percussion structures are capable of being retracted (e.g. lowered) when not in use and extended (e.g. raised) when providing the sonic percussive waveform. Other advantages will be recognized by those of ordinary skill in the art.

In one example, the sonic percussion therapy assembly includes a first inflatable cell, a second inflatable cell, and a sonic percussion structure. The second inflatable cell is beneath the first inflatable cell. The sonic percussion structure is attached to the first and second inflatable cells and disposed between the first and second inflatable cells. In one example, the first and second inflatable cells move the sonic percussion structure in response to fluid pressure. In one example, the sonic percussion structure provides a sonic percussive waveform in response to at least frequency and intensity information. In one example, the first inflatable cell inflates when the second inflatable cell deflates. In one example, the second inflatable cell inflates when the first inflatable cell deflates.

In one example, a therapy control apparatus includes a sonic percussion control module and a position control module. The sonic percussion control module independently controls frequency and intensity of a sonic percussion structure. The position control module selectively raises and lowers the sonic percussion structure with respect to a patient surface. In one example, the position control module controls at least one inflatable cell, operatively coupled to the sonic percussion structure, to one of inflate and deflate. In one example, the position control module controls at least one inflatable cell to deflate and concurrently controls at least one other inflatable cell to inflate. In one example, the at least one inflatable cell and the at least one other inflatable cell are vertically stacked. In one example, the therapy control apparatus includes at least one accelerometer. The accelerometer determines frequency information and/or intensity information of a sonic percussion waveform provided by the sonic percussion structure. In one example, the accelerometer determines a three dimensional position of the patient surface. In one example, the sonic percussion control module selectively adjusts frequency and/or intensity of the sonic percussion structure in response to the frequency information and/or intensity information of the sonic percussion waveform. In one example, the accelerometer is adapted to be operatively coupled to a patient lying on the patient surface. In one example, the position control module concurrently raises a first portion of the sonic percussion structure and lowers a second portion of the sonic percussion structure.

As used herein, the term "module" can include an electronic circuit, one or more processors (e.g., shared, dedicated, or group of processors such as but not limited to microprocessors, DSPs, or central processing units) and memory that execute one or more software or firmware programs, combinational logic circuits, an ASIC, and/or other suitable components that provide the described functionality.

Referring now to FIG. 1, an exemplary bed 10 includes a support structure 12, such as a frame, a patient support apparatus 14, such as a mattress, that is supported by the support structure 12 and a fluid distribution support surface product 16. Although the patient support apparatus 14 is included in a bed in this example, those of ordinary skill in the art will appreciate that the patient support apparatus 14 can be used in other structures such as a chair, a wheelchair, or other suitable structure. In this example, the fluid distribution support surface product 16 serves as a type of inflatable top cover for a patient. As shown, the fluid distribution support surface product 16 has a planar surface 18 adapted to substantially cover the patient support apparatus 14. Also in this example, the bed includes side safety panels 20 and end safety panels as known in the art and also includes a therapy control module 21. The therapy control module 21 is operative to control percussion therapy via communication path 22 and/or other desirable therapies such as rotational therapy for example. Although the communication path 22 is a wired connection in this example, the communication path 22 can be a wireless connection or any other suitable connection.

In some embodiments, the therapy control module 21 can include a programmable fluid supply source 23 such as a programmable air loss pump as known in the art or other suitable fluid pump known in the art. The programmable fluid supply 23 provides low pressure fluid (e.g., air or other suitable fluid) through one or more tubes 24 to the fluid distribution support surface product 16. The programmable fluid supply source 23 need not be programmable and may be any suitable pump or other fluid supply source as desired. By way of example only, such a fluid supply source may be of a type sold by Kap Medical, Inc. located in Corona, Calif., USA, or any other suitable air supply source.

As shown, the fluid distribution support surface product 16 includes an accelerometer 26 operatively coupled to the planar surface 18. In one embodiment, the accelerometer 26 can be any known accelerometer capable of measuring acceleration in three dimensions. In other embodiments, the accelerometer 26 can be capable of measuring acceleration in one or two dimensions rather than three dimensions. The accelerometer 26 is operative to measure frequency and/or intensity information of vibrations provided during percussion therapy. The accelerometer 26 can provide the frequency and/or intensity information to the control module 21 via a wired connection 27 as shown or via any other suitable interface such as a wireless connection for example. The frequency and intensity information can then be used by the therapy control module 21 to selectively adjust the frequency and/or intensity of the percussion therapy. In some embodiments, the accelerometer 26 can be placed directly on the patient via sticky pads as known in the art or by other suitable known methods. In addition, the accelerometer 26 can determine a three-dimensional position (or other dimensional position) of the fluid distribution support surface product 16.

Figure 2:
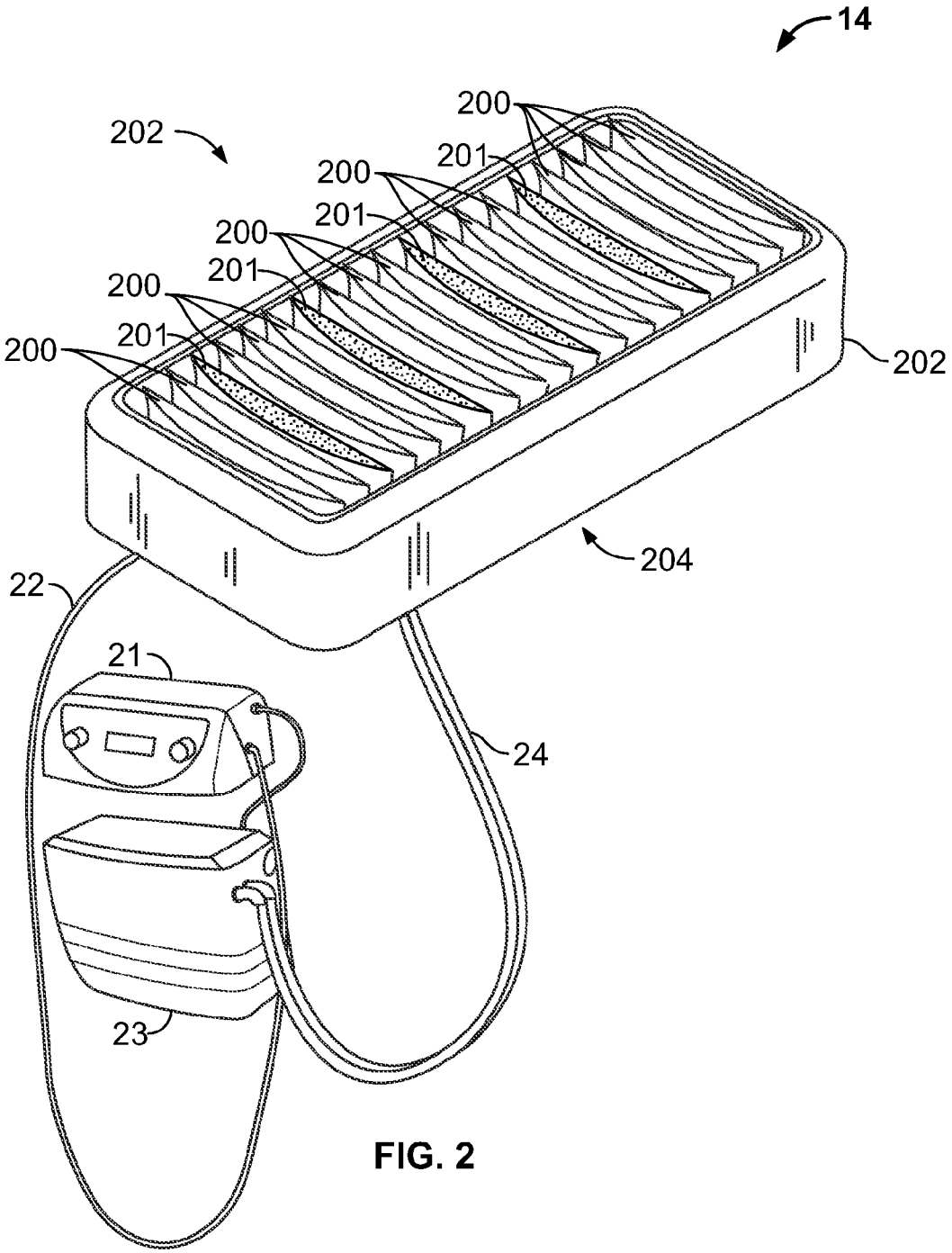
FIG. 2 is an exemplary diagram of the patient support apparatus.

Referring now to FIG. 2, an exemplary diagram of the patient support apparatus 14 is depicted. The patient support apparatus 14 includes a plurality of inflatable cells 200 and a plurality of sonic percussion therapy assemblies 201 within a frame 202. The inflatable cells 200 can be any suitable fluid resistant material known in the art. In this example, the patient support apparatus 14 includes four sonic percussion therapy assemblies 201 although more or less sonic percussion therapy assemblies 201 can be included. The sonic percussion therapy assemblies 201 in this example are arranged to provide percussion therapy to the upper chest, lower back, thigh, and calf of a patient. In some embodiments, it may be desirable to arrange one or more sonic percussion therapy assemblies 201 within the patient support apparatus 14 in order to provide percussion therapy to other locations of the patient.

The frame 202 includes a frame base 204 that extends throughout the open area between the frame 202. As shown, the frame 202, which in this embodiment is an inflatable frame, contains a plurality of inflatable cells 200. The inflatable cells 200 and sonic percussion therapy assemblies 201 rest upon the frame base 204. As shown, the top of the inflatable cells 200 and sonic percussion therapy assemblies 201 are not attached to the frame 202, nor are such tops restricted. The fluid distribution support surface product 16 is placed over what are shown here as exposed inflatable cushion cells 200 and sonic percussion therapy assemblies 201 such that the skin of the patient does not contact the inflatable cells 200 or sonic percussion therapy assemblies 201. The plurality of inflatable cells 200 inflate and deflate in response to the operation of the therapy control module 21.

Figure 3:
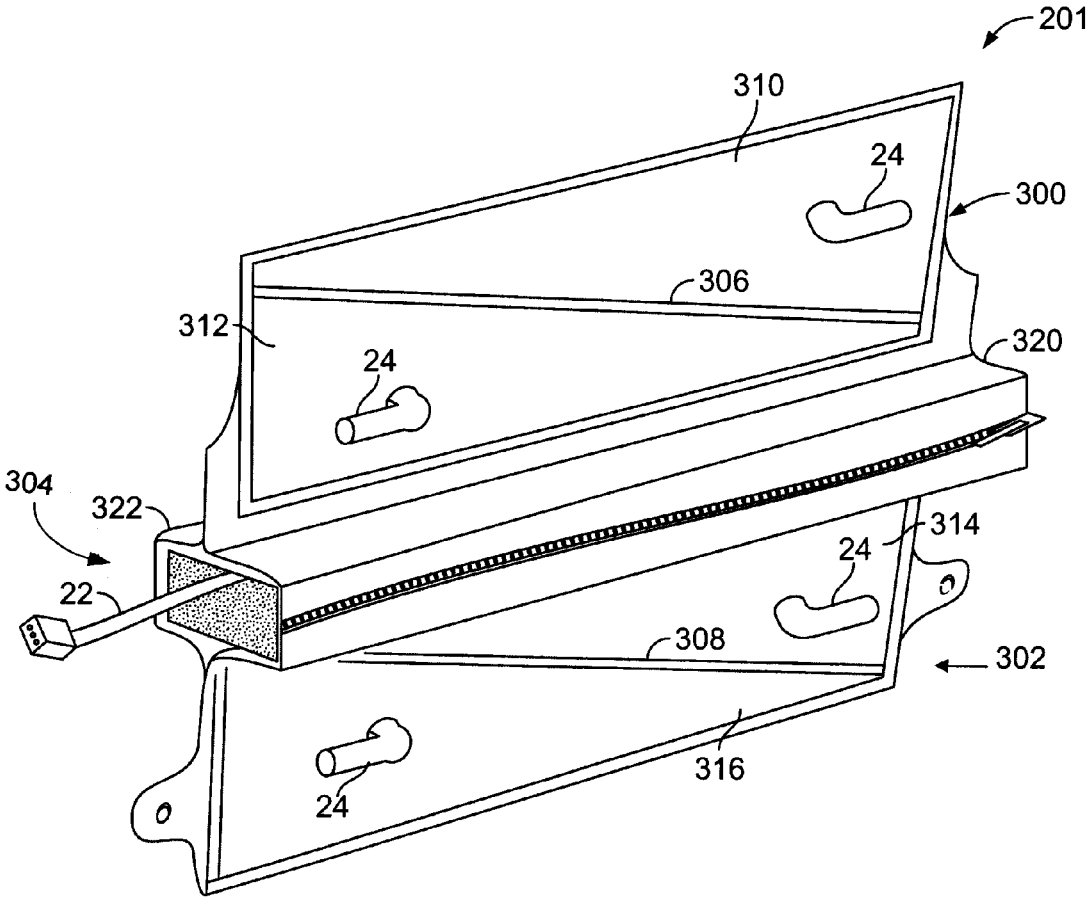
FIG. 3 is an exemplary diagram of a sonic percussion therapy assembly.

Referring now to FIG. 3, in one embodiment, each of the sonic percussion therapy assemblies 201 includes a first inflatable cell structure 300, a second inflatable cell structure 302, and a sonic percussion structure 304. The first and second inflatable cell structures 300, 302 can be made of any suitable fluid resistant material known in the art. As shown, the first and second inflatable cell structures 300, 302 are vertically stacked. In addition, the second inflatable cell structure 302 is beneath the first inflatable cell structure 300. The sonic percussion structure 304 is attached to the first inflatable cell structure 300 and the second inflatable cell structure 302 and disposed between the first inflatable cell structure 300 and second inflatable cell structure 302.

In this embodiment, the first inflatable cell structure 300 and the second inflatable cell structure 302 are operative to move the sonic percussion structure 304 in response to fluid pressure received via tubes 24. For example, the first inflatable cell structure 300 can inflate while the second inflatable cell structure 302 concurrently deflates and vice versa. In addition, the sonic percussion structure 304 is operative to provide a sonic percussive waveform in response to frequency information, intensity information, and/or other suitable information received via communication path 22.

In some embodiments, the first and second inflatable cell structures 300, 302 can be standard inflatable cells as known in the art. In other embodiments, the first and second inflatable cell structures 300, 302 can each include a diagonal seal 306, 308, respectively. When the first inflatable cell structure 300 includes the diagonal seal 306 two separate inflatable cells are formed 310, 312 as shown. Similarly, when the second label cell structure 302 includes the diagonal seal 308 two separate inflatable cells 314, 316 are formed as shown. As such, the therapy control module 21 can selectively inflate and deflate the inflatable cells 310, 312, 314, 316 in order to raise, lower, and/or rotate the planar surface 18 of the patient support apparatus 14 and the sonic percussion structure 304. For example, in order to rotate the sonic percussion structure 304, the therapy control module 21 can concurrently raise a first portion 320 and lower a second portion 322 of the sonic percussion structure 304 by selectively inflating and deflating the inflatable cells 310, 312, 314, 316. An example of an inflatable cell structure that includes a diagonal seal separating two separate inflatable cells is described in U.S. Pat. No. 7,171,711, which is hereby incorporated by reference in its entirety.

Figure 4:
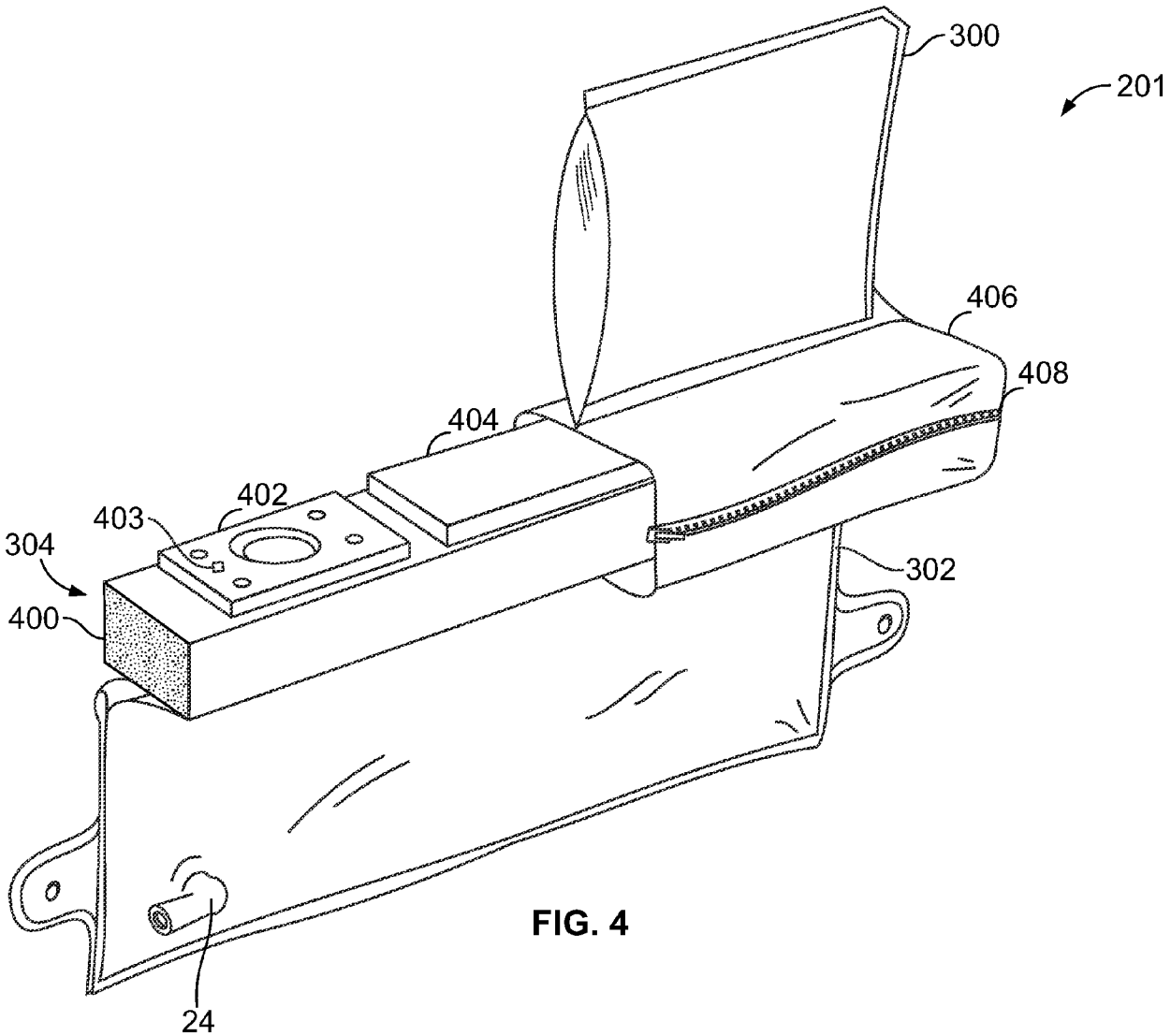
FIG. 4 is an exemplary cutaway diagram of another embodiment of the sonic percussion therapy assembly.

Referring now to FIG. 4, a cutaway view of the sonic percussion therapy assembly 201 is depicted. In this example, the first and second inflatable cell structures 300, 302 are standard inflatable cells and do not include the diagonal seal 306, 308. The sonic percussion structure 304 includes a base structure 400 that is substantially the same length as the first and second inflatable cell structures 300, 302. The base structure 400 can be made of any suitable material such as foam for example. The base structure 400 is operatively coupled to one or more sonic percussion speakers 402. The sonic percussion speakers 402 can be any suitable speaker capable providing sonic percussive waveforms and/or vibrations such as, for example, speakers sold by D2RM Corporation of Gardenia, Calif. having a part number 8002-01. In addition, the sonic percussion speakers 402 should be capable of providing a sonic percussive waveform having a frequency that is independent from the intensity of the waveform.

The sonic percussion speakers 402 provide a percussive waveform in response to frequency, intensity, and/or other suitable control information received via communication path 22. In one example, the frequency and/or intensity of the sonic percussive waveform can be controlled via a pulse width modulated signal. For example, in order to increase intensity of the sonic percussive waveform, a duty cycle of the pulse width modulated signal can be adjusted so that the speaker is on more often than in a previous duty cycle.

The therapy control module 21 controls the frequency, intensity, and/or duration of the percussive waveform in order to provide percussion therapy to the patient. The frequency, intensity, and/or duration of the percussive waveform can each be controlled independently by the therapy control module 21 via the communication path 22. As such, the therapy control module 21 can adjust the frequency, intensity, and/or duration of the percussive waveform to a unique setting for each individual patient. This is desirable because each patient may respond better to percussive waveforms at different frequencies and/or intensities based on their particular body mass and/or other physical characteristics.

In some embodiments, the control module 21 can automatically adjust the frequency, intensity, and/or duration of the percussive waveform in response to feedback information received from the accelerometer 26. In addition, each sonic percussion speaker 402 can be individually controlled so that one side of the patient can receive sonic percussion therapy while the other side does not receive sonic percussion therapy. This may be desirable, for example, when a user wishes to provide sonic percussion and or vibration therapy to one lung of a patient and not the other lung.

In some embodiments, a temperature sensor 403 can be operatively coupled to the speaker 402 to monitor operating temperature of the speaker 402. The operating temperature of the speaker 402 can be provided to the control module 21 via the communication path 22. The control module 21 can selectively disable the speaker 402 based on the operating temperature in order to prevent the speaker 402 from overheating.

The sonic percussion structure 304 can also include an additional top portion 404 in order to enclose the sonic percussion speaker 402 if desired. The top portion 404 can be made of any suitable material such as foam for example. In addition, the sonic percussion structure 304 can be attached to the first and second inflatable cell structures 300, 302, in any suitable manner. In this example, the sonic percussion structure 304 is disposed within a sheath 406 that is attached to the first and second inflatable cell structures 300, 302. In this example, the sheath 406 includes a zipper 408 so the sonic percussion structure 304 can be easily inserted into and removed from the sheath 406.

Figure 5:
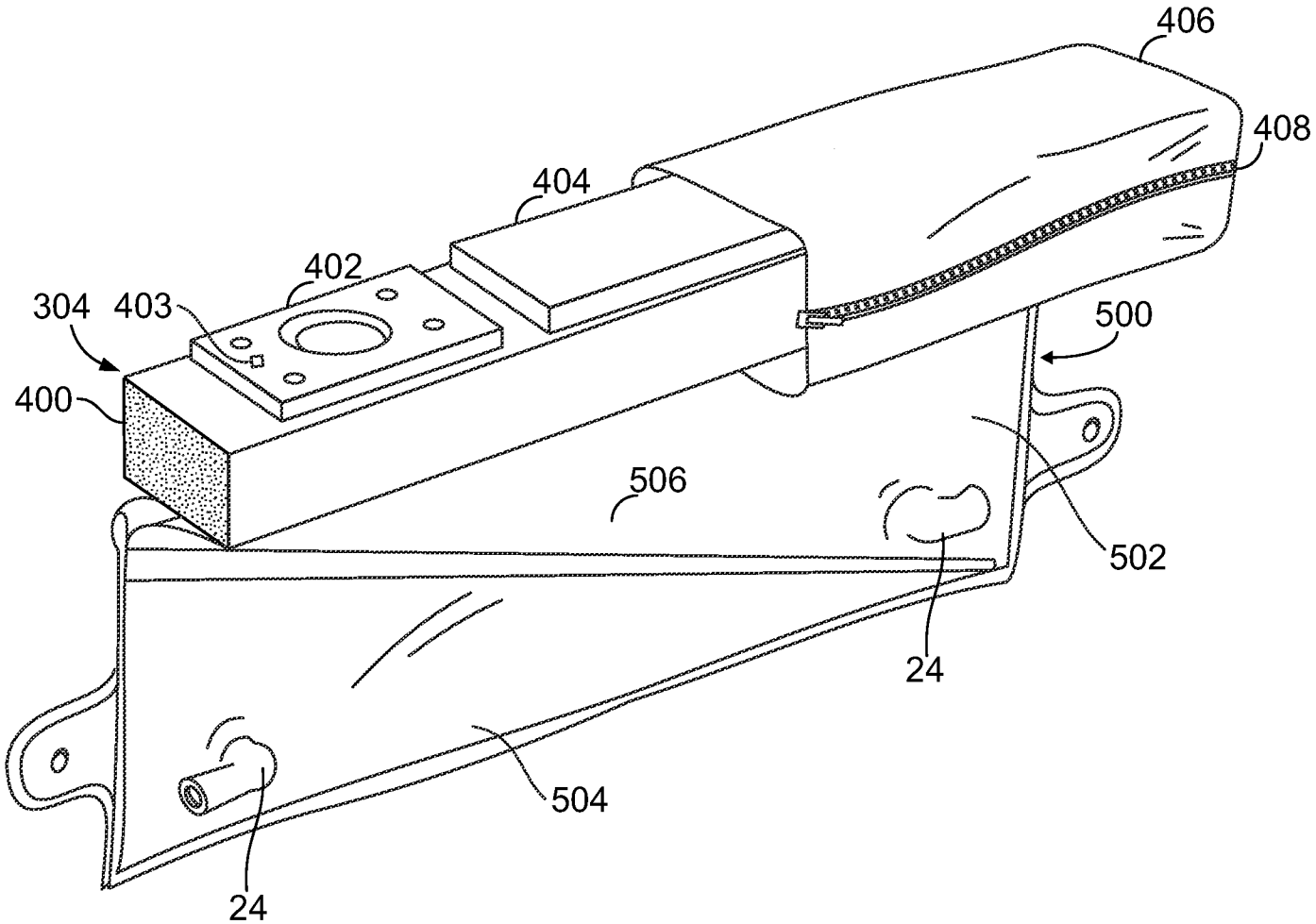
FIG. 5 is an exemplary cutaway diagram of another embodiment of the sonic percussion therapy assembly.
Figure 6:
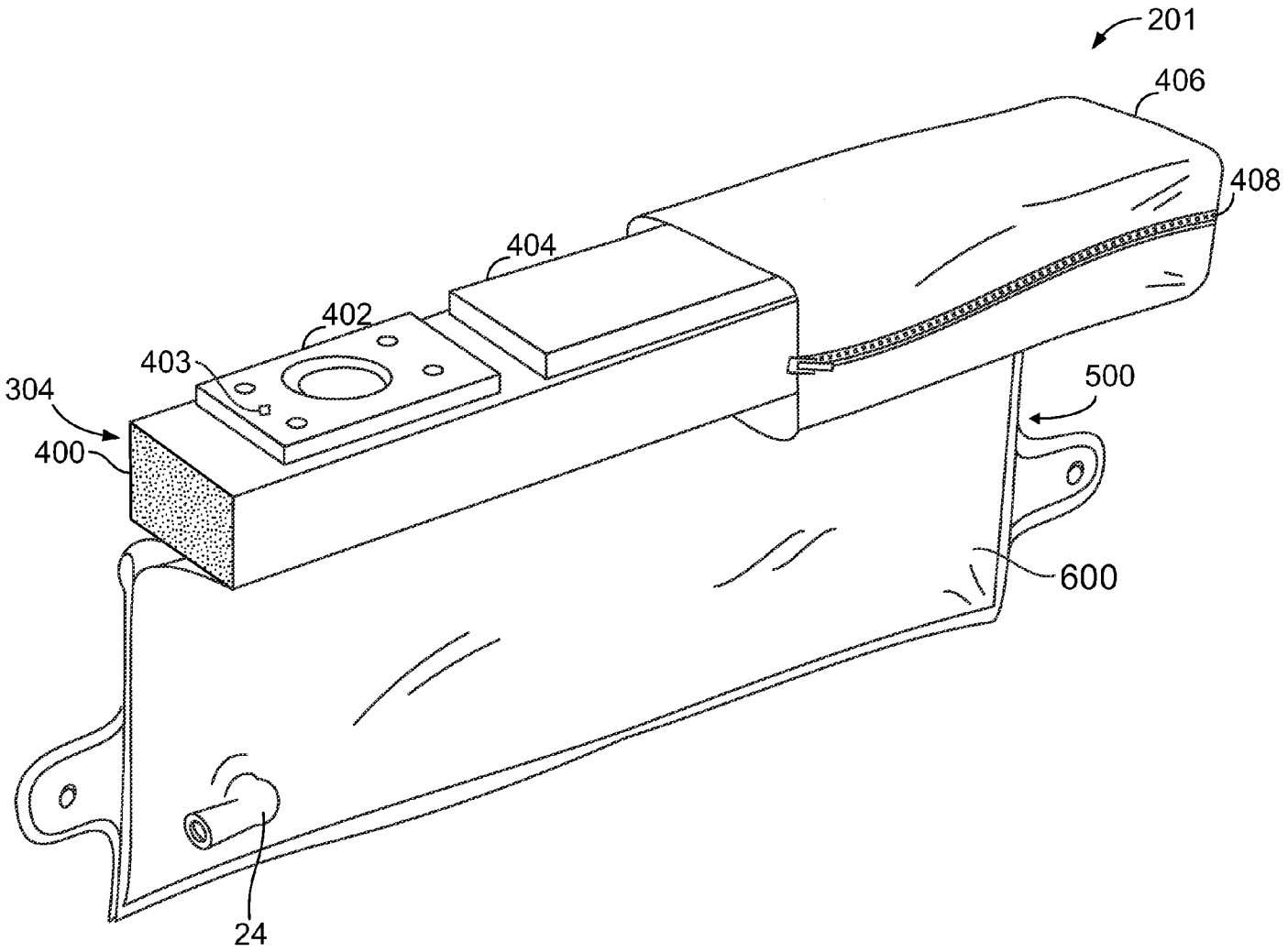
FIG. 6 is an exemplary cutaway diagram of another embodiment of the sonic percussion therapy assembly.
Figure 7:
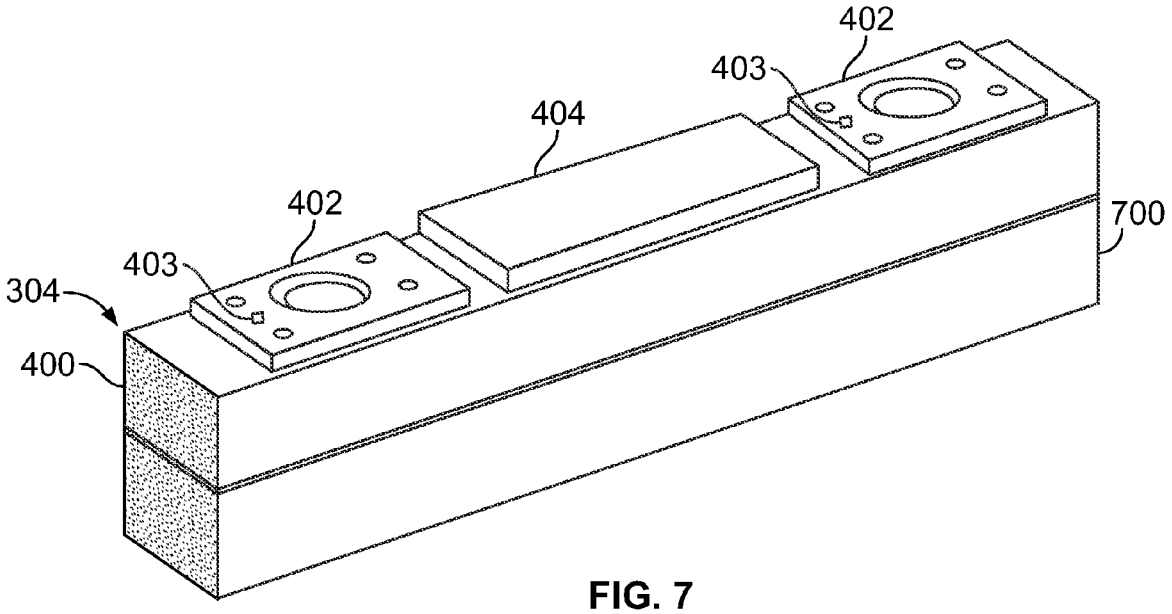
FIG. 7 is an exemplary diagram of yet another embodiment of the sonic percussion therapy assembly.

Referring now to FIGS. 5 and 6, alternative embodiments of the sonic percussion therapy assembly 201 are depicted. In these examples, the sonic percussion therapy assembly 201 includes an inflatable cell structure 500 attached to the sonic percussion structure 302. The inflatable cell structure 500 can be made of any suitable fluid resistant material known in the art. In addition, as with the first and second inflatable cell structures 300, 302 of FIG. 3, the inflatable cell structure 500 can include a single inflatable cell 600 as shown in FIG. 6 or two inflatable cells 502, 504 separated by a diagonal seal 506 as shown in FIG. 5. In addition, in some embodiments, the sonic percussion structure 304 can be attached to a base structure 700 as shown in FIG. 7. The base structure 700 can be made of any suitable material such as foam for example. As such, the sonic percussion structure 304 remains stationary during sonic percussion therapy in the embodiment shown in FIG. 7.

Figure 8:
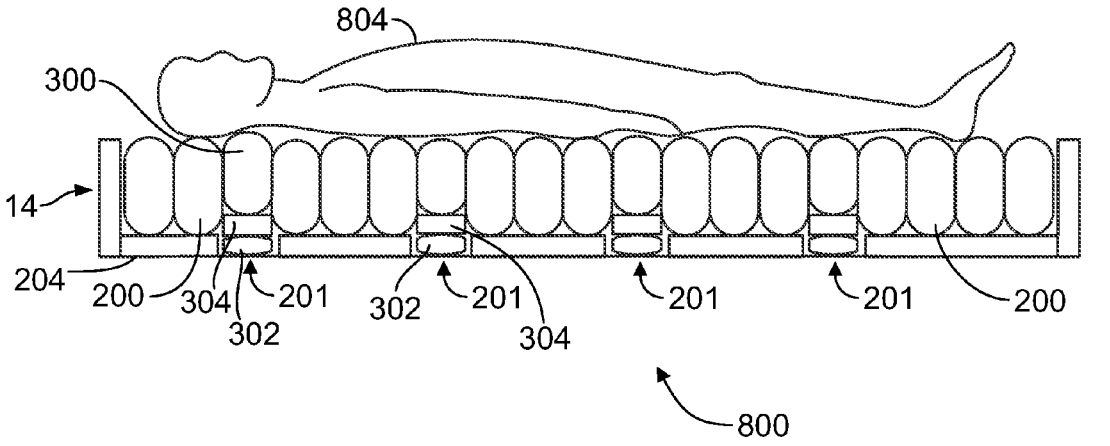
FIG. 8 depicts exemplary cutaway side views of the patient support apparatus when sonic percussion therapy is being provided and not being provided.
Figure 8:
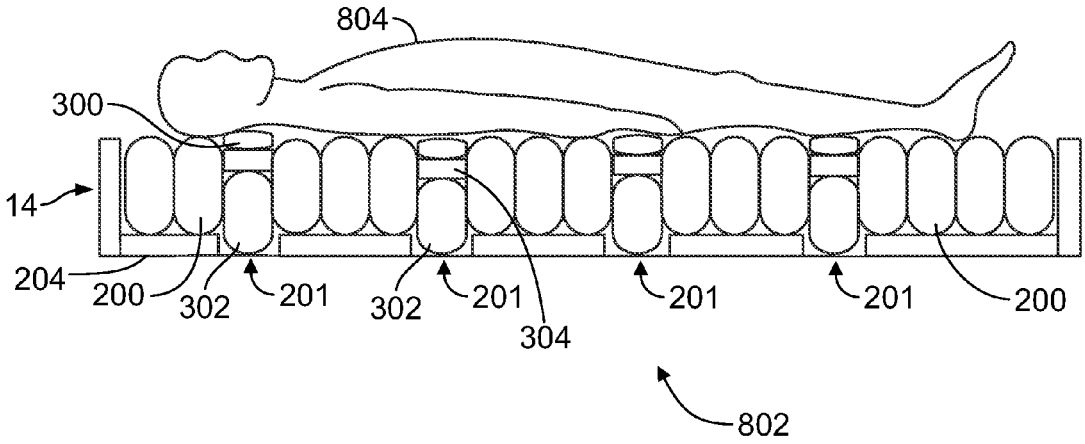

Referring now to FIG. 8, exemplary cutaway side views of the patient support apparatus 14 are generally identified at 800 and 802. The patient support apparatus 14 includes a plurality of the sonic percussion therapy assemblies 201. In this example, the patient support apparatus 14 includes four sonic percussion therapy assemblies 201 although more or less sonic percussion therapy assemblies 201 can be included. The sonic percussion therapy assemblies 201 in this example are arranged to provide percussion therapy to the upper chest, lower back, thigh, and calf of the patient 804. In some embodiments, it may be desirable to arrange one more sonic percussion therapy assemblies 201 within the patient support apparatus 14 in order to provide percussion therapy to other locations of the patient 802.

The patient support apparatus 14 generally identified at 800 illustrates the patient support apparatus 14 when the patient 804 is not receiving sonic percussion therapy treatment. As shown, the sonic percussion structure 304 is retracted (e.g. lowered) and not providing sonic percussion therapy to the patient 804. In some embodiments, the sonic percussion structure 304 is retracted within the frame base 204. Although the sonic percussion therapy assembly 201 in this example includes the first inflatable cell structure 300, the sonic percussion therapy assembly 201 does not need to include the first inflatable cell structure 300 as noted above with reference to FIGS. 5, 6, and 7.

The patient support apparatus 14 generally unidentified at 802 illustrates a patient support apparatus 14 when the patient 802 is receiving sonic percussion therapy treatment. As shown in this example, the sonic percussion structure 304 is extended (e.g. raised) toward the patient 802 and provides a sonic percussive waveform to the patient 802. As previously noted, the sonic percussion therapy assembly 201 can include the first inflatable cell structure 300 or, if desired, need not include the first inflatable cell structure 300.

Figure 9:
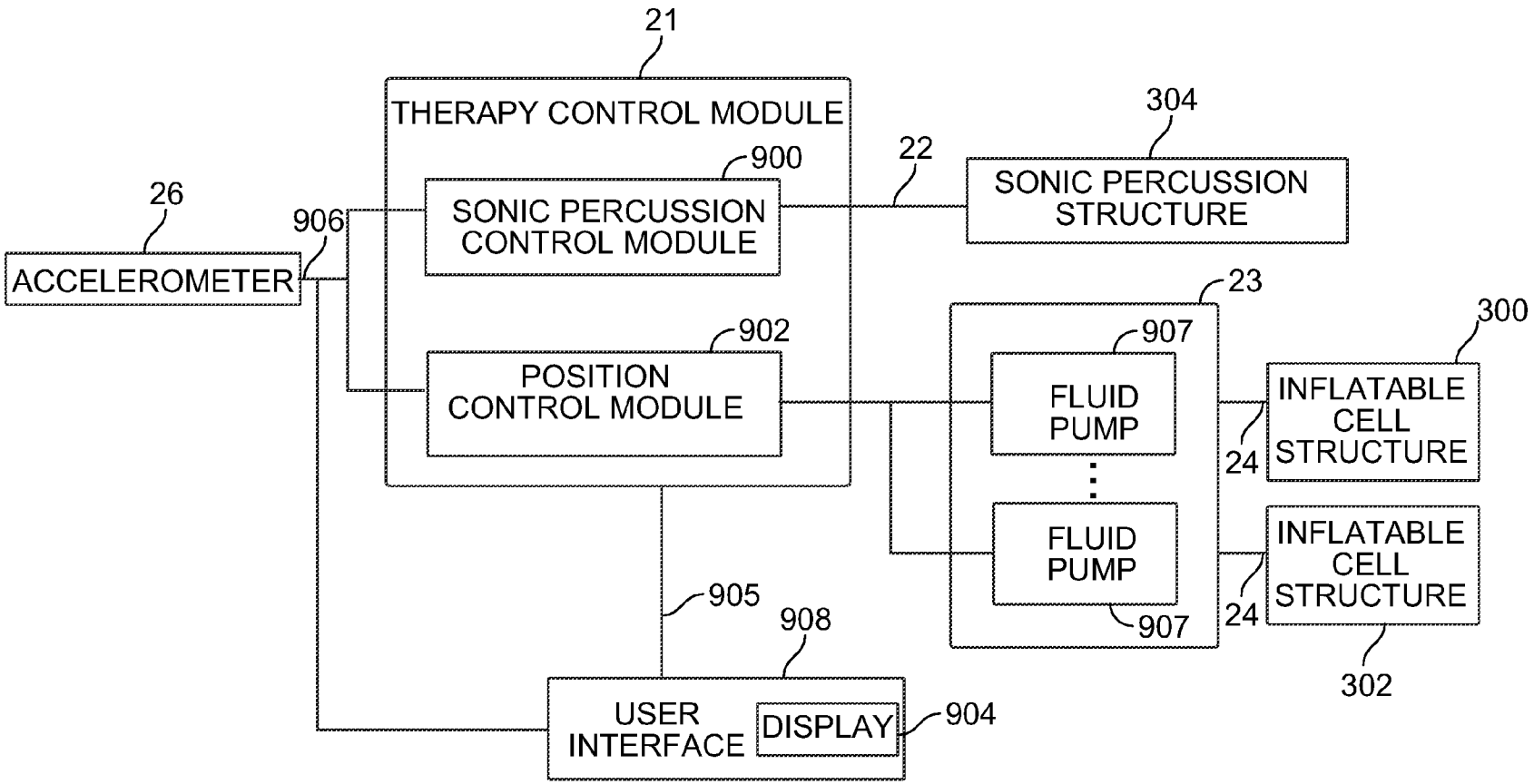
FIG. 9 is an exemplary functional block diagram of a therapy control module that controls a sonic percussion therapy assembly according to the present disclosure.

Referring now to FIG. 9, an exemplary functional block diagram of the therapy control module 21 is depicted. The therapy control module 14 includes a sonic percussion control module 900 and position control module 902. The sonic percussion control module 900 independently controls frequency and intensity of the sonic percussion structure 304. The position control module 902 selectively raises and lowers the sonic percussion structure 304 with respect to the planar surface 18.

The therapy control module 21 can also include a user interface 908 so that a user can interact with the therapy control module 21 via user control information 905 in order to provide therapy in the form of percussion, vibration, and/or rotational therapy. The user interface 904 can also provide feedback information 906 received from the accelerometer 26 to a user via a display 908. The feedback information 906 can include, among other things, frequency, intensity, therapy duration, position of the planar surface 18, and/or any other suitable information. In addition, the user interface 904 and the therapy control module 21 can be included in one unit if desired.

In addition, the sonic percussion control module 900 and the position control module 902 can receive the feedback information 906 in order to automatically adjust the sonic percussion therapy and/or rotational therapy provided by the patient support apparatus 14. For example, the sonic percussion control module 900 and sonic position control module 902 can each include a suitable feedback control module (not shown) such as, for example, a PI, a PD, a PID, and/or any other suitable feedback control module in order to adjust the sonic percussion therapy and/or rotational therapy to a desired therapy setting.

The sonic percussion control module 900 is operatively coupled to the sonic percussion structure 302. The sonic percussion control module 900 controls the frequency, intensity, and/or duration of the sonic percussion therapy. As previously noted, the sonic percussion control module 900 can adjust the frequency independent of adjusting the intensity of the sonic percussion therapy. As such, the sonic percussion control module 900 can provide sonic percussion therapy that is customized to a particular patient.

Furthermore, the sonic percussion control module 900 can control each of the sonic percussion speakers 402 independently. In this manner the sonic percussion control module 900 can selectively provide sonic percussion therapy to particular areas of the patient 804. For example, the sonic percussion control module 900 can provide sonic percussion therapy to a left lung of the patient 804 without providing sonic percussion therapy to a right lung of the patient 804.

The programmable fluid supply source 23 can include one or more fluid supply pumps 907. Each of the fluid supply pumps 907 are in fluid communication with a respective inflatable cell structure 908. For example, when the sonic percussion therapy assemblies 201 include the first and second inflatable cell structures 300, 302, a first of the fluid supply pumps 907 is in fluid communication with the first inflatable cell structure 300 and a second of the fluid supply pumps 907 is in fluid communication with the second inflatable cell structure 302. As such, the position control module 902 can control the programmable fluid supply source 23 to inflate the first inflatable cell structure 300 and concurrently deflate the second inflatable cell structure 302 or vice versa. Those of ordinary skill in the art will appreciate that the fluid supply pumps 907 can be in fluid communication with any other suitable cell structure desired to be inflated and/or deflated.

Figure 10:
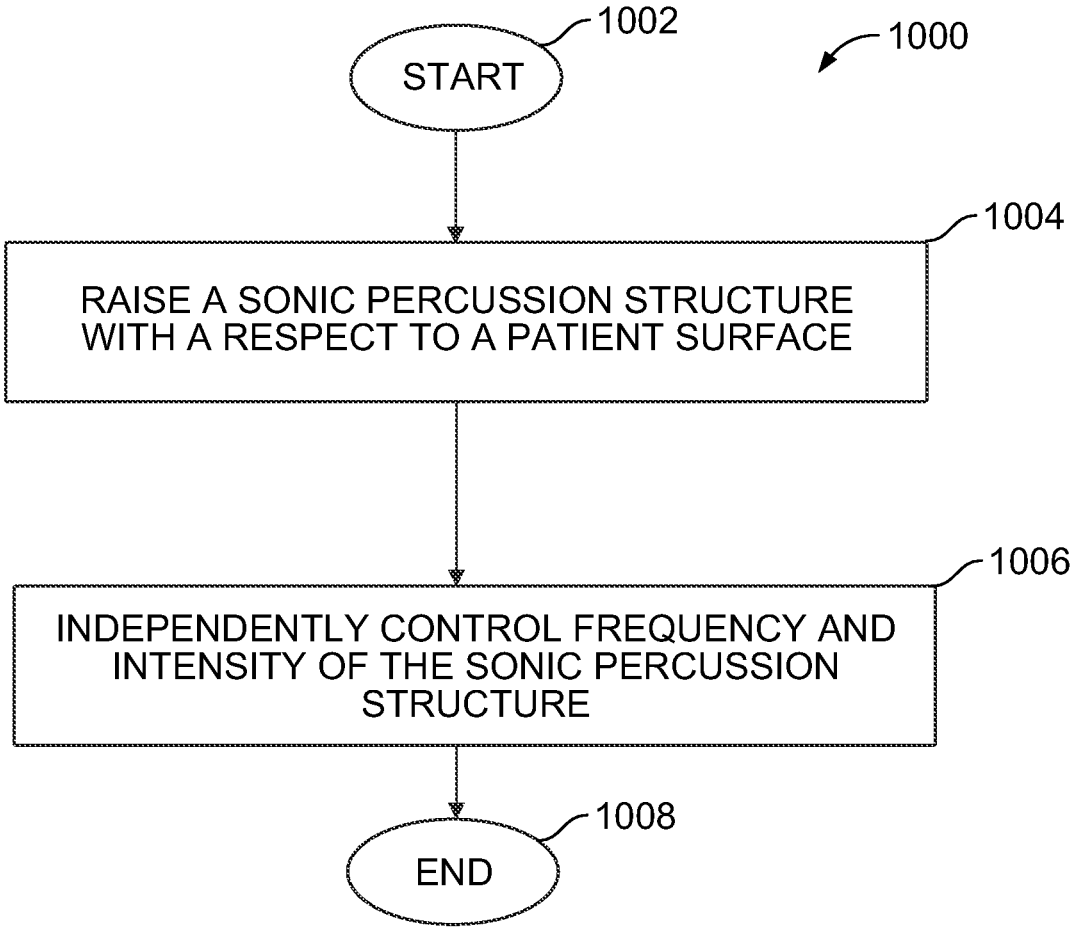
FIG. 10 is an exemplary flowchart depicting steps that can be taken by the therapy control module.

Referring now to FIG. 10, exemplary steps that can be taken by the control module 21 in order to provide percussion therapy are generally identified at 1000. The process starts in step 1002 when a user desires to provide sonic percussion therapy to a patient. In step 1004, the control module 21 raises the sonic percussion structure 304 with respect to a patient surface (e.g. the planar surface 18). In step 1006, the control module independently controls the frequency and intensity of the sonic percussion structure 304. The process ends in step 1008. As previously noted, the sonic percussion structure 304 can be lowered with respect to the patient surface (e.g. the planar surface 18) when sonic percussion therapy is not being provided.

As noted above, among other advantages, the sonic percussion system, apparatus and method provide sonic percussion therapy having a sonic percussive waveform, wherein the frequency and intensity of the waveform can be independently controlled to provide customized treatment to for each individual patient. In addition, the system, method and apparatus can selectively target a particular area of the patient's body in order to provide customized treatment for that particular area of the body. Furthermore, the sonic percussion structures are capable of being retracted (e.g. lowered) when not in use and extended (e.g. raised) when providing the sonic percussive waveform. Other advantages will be recognized by those of ordinary skill in the art.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

What is claimed is:

1. A sonic percussion therapy assembly, comprising:

a first inflatable cell;

a second inflatable cell beneath the first inflatable cell; and a sonic percussion structure comprised of a plurality of speakers, attached between the first and second inflatable cells via an attachment mechanism and positioned above the second inflatable cell.

2. The sonic percussion therapy assembly of claim 1 wherein the sonic percussion structure is comprised of a base structure that houses the plurality of speakers and wherein the first and second inflatable cells are configured to move the sonic percussion structure in response to changes in fluid pressure.

3. The sonic percussion therapy assembly of claim 1 wherein the sonic percussion structure is operative to provide a sonic percussive waveform in response to at least frequency and intensity information.

4. The sonic percussion therapy assembly of claim 1 wherein the first inflatable cell is operative to inflate when the second inflatable cell deflates and the second inflatable cell is operative to inflate when the first inflatable cell deflates.

5. A sonic percussion therapy assembly, comprising:

an inflatable cell comprising a diagonal seal that seals sidewalls of the inflatable cell; and a sonic percussion structure comprised of a plurality of speakers attached via an attachment mechanism to a top of the inflatable cell.

6. The sonic percussion therapy assembly of claim 5 wherein the inflatable cell is operative to move the sonic percussion structure in response to fluid pressure.

7. The sonic percussion therapy assembly of claim 5 wherein the sonic percussion structure is operative to provide a sonic percussive waveform in response to at least frequency and intensity information.

8. A patient support apparatus, comprising:

a plurality of sonic percussion therapy assemblies arranged to support a patient, each comprising:

a first inflatable cell;

a second inflatable cell beneath the first inflatable cell;

a sonic percussion structure comprised of a plurality of speakers, attached between the first and second inflatable cells via an attachment mechanism and positioned above the second inflatable cell; and a plurality of inflatable cushion cells arranged to support the patient.

9. The patient support apparatus of claim 8 wherein the plurality of sonic percussion therapy assemblies are operative to move a respective one of the plurality of sonic percussion structures in response to fluid pressure.

10. The patient support apparatus of claim 8 wherein each of the plurality of sonic percussion structures are operative to provide a respective sonic percussive waveform in response to at least frequency and intensity information.

11. The patient support apparatus of claim 10 wherein at least one sonic percussive waveform differs from another sonic percussive waveform by at least one of frequency and intensity.

12. The patient support apparatus of claim 8 wherein at least one of the plurality of sonic percussion therapy assemblies has a diagonal seal and is operative to inflate when a respective one of the second plurality of inflatable cells deflates and the respective one of the second plurality of inflatable cells is operative to inflate when the at least one of the first plurality of inflatable cells.

13. A therapy control apparatus, comprising:

a sonic percussion control module that is operative to provide frequency and intensity control information to independently control at least frequency and intensity of a plurality of speakers of a sonic percussion structure;

a position control module that is operative to selectively raise and lower the sonic percussion structure;

an accelerometer operatively coupled to the sonic percussion module and the position control module, wherein the sonic percussion control module and the position control module are responsive to a feedback signal from the accelerometer; and wherein the accelerometer is adapted to be operatively coupled to a patient proximate a patient surface.

14. The therapy control apparatus of claim 13 wherein the position control module is operative to control at least one inflatable cell to deflate and to concurrently control at least one other inflatable cell to inflate.

15. The therapy control apparatus of claim 13 wherein the at least one accelerometer is operative to determine a three dimensional position of the patient surface.

16. The therapy control apparatus of claim 13 wherein the sonic percussion control module is operative to selectively adjust at least one of frequency and intensity of the sonic percussion structure in response to the at least one of frequency information and intensity information of the sonic percussion waveform.

17. The therapy control apparatus of claim 13 wherein the position control module is operative to concurrently raise a first portion of the sonic percussion structure and lower a second portion of the sonic percussion structure.

18. A sonic percussion therapy system, comprising:

a patient support apparatus that comprises:

a plurality of sonic percussion therapy assemblies each comprising:

a first inflatable cell;

a second inflatable cell beneath the first inflatable cell;

a sonic percussion structure comprised of a plurality of speakers, attached between the first and second inflatable cells via an attachment mechanism and positioned above the second inflatable cell;

a control module that comprises:

a sonic percussion control module that is operative to independently control at least frequency and intensity of at least one of the plurality of sonic percussion structures; and a position control module that is operative to selectively raise and lower at least one of the plurality of sonic percussion structures with respect to a patient surface.

19. The sonic percussion therapy system of claim 18 further comprising a top cover that comprises:

a planar surface adapted to substantially cover the patient support apparatus; and at least one accelerometer, operatively coupled to the planar surface, that is operative to measure at least one of frequency and intensity of vibrations of the patient support apparatus.

20. A therapy control apparatus, comprising:

a sonic percussion control module that is operative to independently control at least frequency and intensity of a sonic percussion structure having a plurality of speakers;

a position control module that is operative to selectively raise and lower the sonic percussion structure using, a plurality of inflatable cells; and wherein at least one inflatable cell and least one other inflatable cell are vertically stacked and are attached via an attachment mechanism attached to both the first and second inflatable cells to the sonic percussion structure.

21. A method of providing sonic percussion therapy, comprising:

raising a sonic percussion structure having a plurality of speakers with respect to a patient surface;

independently controlling frequency and intensity of the sonic percussion structure; and controlling at least one inflatable cell, attached via an attachment mechanism to the sonic percussion structure, to one of inflate and deflate.

22. A method of providing sonic percussion therapy, comprising:

raising a sonic percussion structure having a plurality of speakers with respect to a patient surface;

the sonic percussion structure comprised of a plurality of speakers, attached between a first and second inflatable cell via an attachment mechanism and positioned above the second inflatable cell, independently controlling frequency and intensity of the sonic percussion structure; and controlling at least one of the first and second inflatable to deflate and to concurrently control at least one other inflatable cell to inflate.

23. The method of claim 22 further comprising determining a three dimensional position of the patient surface.

24. The method of claim 22 further comprising selectively adjusting at least one of frequency and intensity of the sonic percussion structure in response to the at least one of frequency information and intensity information of the sonic percussion waveform.

25. A method of providing sonic percussion therapy, comprising:

raising a sonic percussion structure having a plurality of speakers with respect to a patient surface;

the sonic percussion structure comprised of a plurality of speakers, attached between a first and second inflatable cell via an attachment mechanism and positioned above the second inflatable cell;

independently controlling frequency and intensity of the sonic percussion structure; and determining at least one of frequency information and intensity information of a sonic percussion waveform provided by the sonic percussion structure.

* * * * *